United States Patent [19]

Kawauchi et al.

[11] 4,452,757

[45] Jun. 5, 1984

[54] COPPER ALLOY FOR RADIATORS

[75] Inventors: Susumu Kawauchi, Kanagawa; Junji Honda, Atsugi; Kiyoaki Nishikawa; Masahiro Tsuji, both of Kanagawa, all of Japan

[73] Assignee: Nihon Kogyo Kabushiki Kaisha, Tokyo, Japan

[21] Appl. No.: 440,475

[22] Filed: Nov. 9, 1982

[30] Foreign Application Priority Data

Nov. 13, 1981 [JP] Japan ..... 56-181059

[51] Int. Cl.[3] ..... C22C 9/02; C22C 9/04

[52] U.S. Cl. ..... 420/471; 420/472; 420/476; 420/478

[58] Field of Search ..... 420/471, 472, 476, 478

[56] References Cited

U.S. PATENT DOCUMENTS 1,938,172 12/1933 Crampton ..... 420/478
2,224,095 12/1940 Barry ..... 420/478

FOREIGN PATENT DOCUMENTS 148126 11/1979 Japan ..... 420/478
136946 10/1981 Japan ..... 420/478

*Primary Examiner*—Peter K. Skiff
*Attorney, Agent, or Firm*—Seidel, Gonda & Goldhammer

[57] ABSTRACT

Corrosion-resistant copper alloys for the manufacture of radiators are composed of, by weight, 25–40% zinc, 0.005–0.070% phosphorus, 0.05–1.0% each tin and aluminum, and the balance copper and inevitable impurities.

2 Claims, No Drawings

COPPER ALLOY FOR RADIATORS

BACKGROUND OF THE INVENTION

This invention relates to a copper alloy adapted for the manufacture of radiators with excellent resistance to corrosive attacks of water containing inorganic salts.

Copper-zinc alloys or so-called brasses, known generally to have corrosion resistance besides good mechanical and working properties, are in use by preference for manufacturing radiators for automobiles. The radiator receives a circulating liquid coolant from the engine to remove heat therefrom and returns it back to the engine for the engine temperature control. It presents a problem of corrosion from the inside normally in contact with the coolant. It can also be corroded outside while being exposed to automotive emissions, salt-laden air along the seashore, or $SO_2$ and other noxious contents in waste gases from industrial plants.

The aggravating air pollution and other corrosive environments have shortened to life of ordinary radiators of brass, typically consisting of 65% copper and 35% zinc by weight. There has been a strong need, therefore, for more corrosion-resistant materials.

BRIEF SUMMARY OF THE INVENTION

As a result of investigations made with the foregoing in view, copper alloys suited for the manufacture of radiators with excellent corrosion resistance have now been developed which comprise, by weight, 25–40% zinc, 0.005–0.070% phosphorus, 0.05–1.0% each tin and aluminum, and the balance copper and inevitably concomitant impurities.

DETAILED DESCRIPTION OF THE INVENTION

The functions of the alloying elements constituting the corrosion-resistant copper alloys of the invention, and the grounds on which their proportions are confined within the specified ranges will now be explained. Copper and zinc, which form the basis of the present alloy, possess excellent workability and mechanical strength, and also is excellent in thermal conductivity. Of the two, zinc is limited in aforementioned percentage because less than 25 wt % zinc will impair the workability of the resulting alloy and more than 40 wt % will cause precipitation of the beta phase in the alloy, adversely affecting the corrosion resistance and cold workability of the product. The amount of phosphorus to be added is limited to the 0.005–0.07 wt % range, since an addition of less than 0.005 wt % will not impart improved corrosion resistance to the alloy whereas an amount exceeding 0.07 wt % will make the alloy more corrosion-proof but tend to invite intergranular corrosion. Tin, to be added in the range of 0.05–1.0 wt %, will not enhance the corrosion resistance if the amount is less than 0.05 wt %, but the favorable effect will be saturated beyond the 1.0 wt %. Exactly the same applied to aluminum, confined in the same range. That is, the addition of less than 0.05 wt % does not provide the improvement of corrosion resistance while on the other hand the addition beyond 1.0 wt % saturates its effect.

In a preferred range, this alloy is consisted essentially of 27–37 wt % zinc, 0.01–0.04 wt % phosphorus, 0.1–0.5 wt % tin, 0.1–0.5 wt % aluminum, the balance being copper and concomitant impurities.

EXAMPLE

Alloys of varied compositions as given in Table 1 were prepared by melting. They were hot rolled and then, with proper annealing, cold rolled to one-millimeter-thick sheets. After final annealing 500° C. for 30 minutes, the sheets were subjected to corrosion resistance tests.

For each test a solution of 1.3 g sodium hydrogen carbonate, 1.5 g sodium sulfate, and 1.6 g sodium chloride in a liter of water was kept at 88° C. Each test specimen was kept immersed in the solution, while air was being injected at a rate of 100 ml per minute, for 336 hours. The depth of dezincification corrosion was measured to evaluate the corrosion resistance of each specimen.

TABLE 1

| Specimen | | (in wt%) Zn | P | Sn | Al | Cu |
|---|---|---|---|---|---|---|
| Conventional alloy | 1 | 30 | — | — | — | bal. |
| " | 2 | 35 | — | — | — | " |
| Inventive alloy | 3 | 27 | 0.005 | 0.10 | 0.05 | " |
| " | 4 | 35 | 0.01 | 0.05 | 0.10 | " |
| " | 5 | 30 | 0.03 | 0.10 | 0.30 | " |
| " | 6 | 37 | 0.02 | 0.7 | 0.50 | " |
| " | 7 | 35 | 0.07 | 1.0 | 0.40 | " |
| " | 8 | 33 | 0.03 | 0.10 | 0.80 | " |
| " | 9 | 32 | 0.05 | 0.50 | 0.30 | " |
| " | 10 | 38 | 0.01 | 0.80 | 0.60 | " |
| " | 11 | 30 | 0.02 | 0.30 | 1.00 | " |
| " | 12 | 35 | 0.02 | 0.20 | 0.20 | " |

Table 2 makes clear that the alloys made in conformity with the invention are highly resistant to dezincification corrosion.

TABLE 2

| Specimen | Depth of dezincification corrosion (μm) |
|---|---|
| Conventional alloy | |
| 1 | 113 |
| 2 | 140 |
| Inventive alloy | |
| 3 | 18 |
| 4 | 15 |
| 5 | 12 |
| 6 | 11 |
| 7 | 10 |
| 8 | 13 |
| 9 | 10 |
| 10 | 16 |
| 11 | 12 |
| 12 | 12 |

What is claimed is:

1. A copper alloy suited for the manufacture of radiators consisting essentially of:
25–40 wt %—zinc,
0.005–0.070 wt %—phosphorus,
0.05–1.0 wt %—tin,
0.05–1.0 wt %—aluminum,
balance—copper and concomitant impurities.

2. A copper alloy as described in claim 1 wherein the alloy consists essentially of:
27–37 wt %—zinc,
0.01–0.04 wt %—phosphorus,
0.1–0.5 wt %—tin,
0.1–0.5 wt %—aluminum,
balance—copper and concomitant impurities.

* * * * *